US010643813B2

(12) United States Patent
Ji et al.

(10) Patent No.: US 10,643,813 B2
(45) Date of Patent: May 5, 2020

(54) AUTOMATIC TRANSFER SWITCH WITH PERMANENT MAGNETIC ACTUATION

(71) Applicant: Cummins Power Generation IP, Inc., Minneapolis, MN (US)

(72) Inventors: Brian Ji, Shanghai (CN); Tony Hu, Shanghai (CN); Zhaoxiang Ma, Shanghai (CN)

(73) Assignee: Cummins Power Generation IP, Inc., Minneapolis, MN (US)

( * ) Notice: Subject to any disclaimer, the term of this patent is extended or adjusted under 35 U.S.C. 154(b) by 617 days.

(21) Appl. No.: 15/317,474

(22) PCT Filed: Jun. 10, 2014

(86) PCT No.: PCT/CN2014/079590
§ 371 (c)(1),
(2) Date: Dec. 9, 2016

(87) PCT Pub. No.: WO2015/188314
PCT Pub. Date: Dec. 17, 2015

(65) Prior Publication Data

US 2017/0103865 A1 Apr. 13, 2017

(51) Int. Cl.
*H01H 50/64* (2006.01)
*H01H 50/54* (2006.01)
(Continued)

(52) U.S. Cl.
CPC ..... *H01H 50/644* (2013.01); *H01H 33/28* (2013.01); *H01H 33/42* (2013.01); *H01H 33/50* (2013.01); *H01H 50/54* (2013.01)

(58) Field of Classification Search
CPC ..... H01H 50/644; H01H 33/28; H01H 33/42; H01H 33/50; H01H 50/54
See application file for complete search history.

(56) References Cited

U.S. PATENT DOCUMENTS 4,503,411 A * 3/1985 Lofstrand ..... H01F 7/1607 335/259
4,590,387 A 5/1986 Yoshida et al.
(Continued)

FOREIGN PATENT DOCUMENTS

CN 101145468 3/2008
CN 101441945 5/2009
(Continued)

OTHER PUBLICATIONS

International Search Report and Written Opinion for PCT/CN2014/079590, dated Feb. 26, 2015, 12 pages.

*Primary Examiner* — Bernard Rojas
(74) *Attorney, Agent, or Firm* — Foley & Lardner LLP

(57) ABSTRACT

A system and method for an automatic transfer switch comprising a fixed contact (26), a first oscillating rod (16) communicatively and operatively connected to a first movable contact (25), a second oscillating rod (18) communicatively and operatively connected to a second movable contact (27), a link rod (12) communicatively and operable connected to the first and second oscillating rods (16, 18), a guide plate (20), and a permanent magnetic actuator (2) comprising a first end and a second end communicatively and operatively connected to the link rod (12) via a third oscillating rod (8), wherein the first end being energized independently of the second end. The automatic transfer switch is operable to position the guide plate (20) based at least on a permanent magnetic force applied to the first end or the second end of the permanent magnetic actuator.

18 Claims, 5 Drawing Sheets

(51) Int. Cl.

| | |
|---|---|
| ***H01H 33/42*** | (2006.01) |
| ***H01H 33/50*** | (2006.01) |
| ***H01H 33/28*** | (2006.01) |

(56) References Cited

U.S. PATENT DOCUMENTS

| | | | | |
|---|---|---|---|---|
| 2003/0090348 | A1* | 5/2003 | Simms | H01H 89/06 335/6 |
| 2006/0213561 | A1* | 9/2006 | Tiwet | G05D 7/005 137/488 |

FOREIGN PATENT DOCUMENTS

| | | | |
|---|---|---|---|
| CN | 101901702 | A | 12/2010 |
| CN | 102034619 | | 4/2011 |
| CN | 103077837 | | 5/2013 |
| CN | 103441008 | A | 12/2013 |
| JP | 2006-040796 | | 2/2006 |
| KR | 20060122242 | | 11/2006 |

* cited by examiner

AUTOMATIC TRANSFER SWITCH WITH PERMANENT MAGNETIC ACTUATION

CROSS-REFERENCE TO RELATED APPLICATIONS

The present application is a U.S. National Stage Application claiming the benefit of International Application No. PCT/CN2014/079590, filed on Jun. 10, 2014, the contents of which are incorporated herein by reference in their entirety.

TECHNICAL FIELD

This present application relates to an automatic transfer switch (ATS) operating mechanism comprising a permanent magnetic actuator.

BACKGROUND

Many automatic transfer switches utilize solenoid or motor operating mechanisms to perform opening and closing operations. Solenoid or motor operating mechanisms can contain complicated structures. For example, the operating mechanisms can include exclusive locking and tripping components to maintain the opening and closing states. Because of the number of components and the precision of manufacturing needed, traditional automatic transfer switches are susceptible to reduced reliability and consistency.

Permanent magnetic operating mechanisms have been applied in medium-voltage vacuum circuit breakers. Existing automatic transfer switches utilize two permanent magnetic operating mechanisms to operate two movable contact subsystems separately. However, these switches can misoperate.

SUMMARY

Various embodiments provide for a system and method for an automatic transfer switch comprising a fixed contact, a first oscillating rod communicatively and operatively connected to a first movable contact, a second oscillating rod communicatively and operatively connected to a second movable contact, a link rod communicatively and operatively connected to the first and second oscillating rods, a guide plate, and a permanent magnetic actuator. The permanent magnetic actuator comprises a first end and a second end communicatively and operatively connected to the link rod via a third oscillating rod. The first end is energized independently of the second end. The automatic transfer switch is operable to position the guide plate based at least on a permanent magnetic force applied to the first end or the second end of the permanent magnetic actuator. In various embodiments, the permanent magnetic actuator can be either of a bistable or a monostable type.

In particular embodiments, the automatic transfer switch is configured to be placed in any of a neutral state, a first non-neutral state, and a second non-neutral state. The first movable contact and the second movable contact may be positioned away from the fixed contact when the automatic transfer switch is in the neutral state. In a particular embodiment, the first movable contact and the second movable contact may be positioned away from the fixed contact at a predetermined rotational angle when the automatic transfer switch is in the neutralstate. In a further embodiment, the first movable contact is in communication with the fixed contact and the second movable contact is positioned away from the fixed contact when the automatic transfer switch is in the first non-neutral state. In a yet another embodiment, the first movable contact is positioned away from the fixed contact and the second movable contact is in communication with the fixed contact when the automatic transfer switch is in the second non-neutral state.

The permanent magnetic actuator may be operable to change a state of the automatic transfer switch from the first non-neutral state to the second non-neutral state. In a further embodiment, the permanent magnetic actuator is operable to change a state of the automatic transfer switch from the first non-neutral state to the second non-neutral state via the neutral state. At least one of the first movable contact and the second movable contact is positioned away from fixed contact, for example during service. The permanent magnetic actuator exerts a permanent magnetic holding force.

Various embodiments of the automatic transfer switches described herein may result in improved reliability and an extended lifetime. Additionally, in various embodiments, the overall complexity and precision required in the manufacture of the automatic transfer switch may be reduced.

These and other features, together with the organization and manner of operation thereof, will become apparent from the following detailed description when taken in conjunction with the accompanying drawings.

DETAILED DESCRIPTION OF VARIOUS EMBODIMENTS

Referring to the figures generally, various embodiments disclosed herein relate to an automatic transfer switch ("ATS") having a permanent magnetic actuator. The permanent magnetic actuator can operate as a two-way independent movement driver. Each end of the permanent magnetic actuator can be energized separately and moved independently while both states of both ends are maintained by permanent magnetic forces. The permanent magnetic actuator operates transmission components to open or close movable contact subsystems onto fixed contact subsystems. The operation of the transmission components by the permanent magnetic actuator moves the selected movable contact subsystem into an open or closed position. The movable contact subsystems are held in place using the force generated from the permanent magnetic actuator without relying on traditional mechanical locking and tripping devices. The automatic transfer switch also includes a mechanical interlock.

Figure 1:
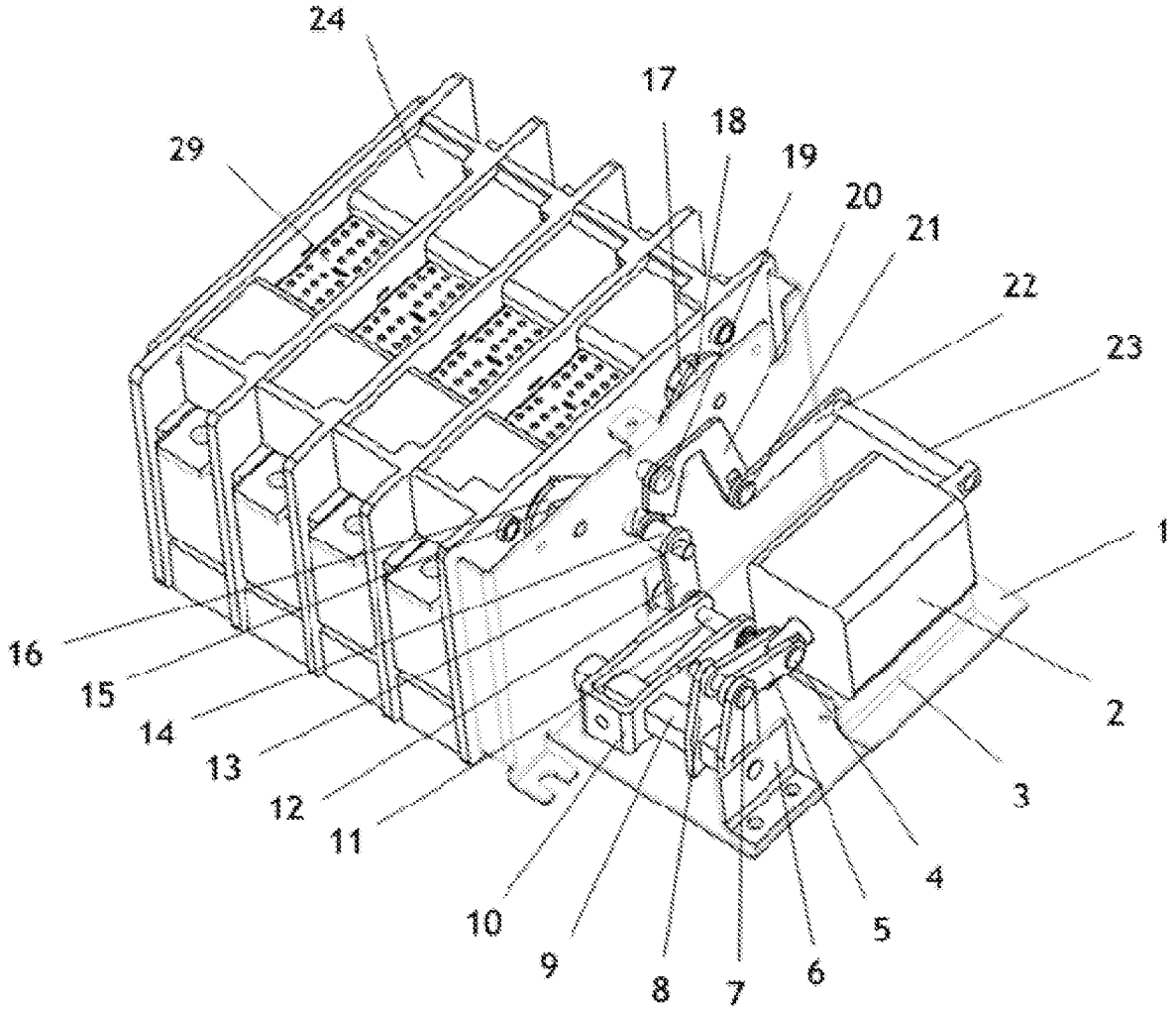
FIG. 1 is an isometric view of an automatic transfer switch according to an example embodiment.

Referring to FIG. 1, a structure view of an automatic transfer switch is illustrated according to an example embodiment. There are at least two-pole contact systems 24 which contain two sources of at least two-pole movable contact subsystem (referred to herein as source A movable contact subsystem 25 and source B movable contact subsystem 27) corresponding fixed contact subsystems 26, protective shells 28 and an arc chute system 29 which are assembled between first and second source movable contact subsystems 25, 27 (e.g., source A and source B). An operating mechanism fixes with contact systems 24 through a baseplate 1 on either the left or right side. The source A movable contact subsystems 25 is coupled to and rotates with a first rotating square shaft 15. The source B movable contact subsystems 27 is coupled to and rotates with square shaft 17. Rotating square shafts 15,17 are connected to baseplate 1 through holes. The first rotating square shaft 15 is coupled to and rotates with a first oscillating rod 16, and the second and rotating square shaft 17 is coupled to and rotates with a second oscillating rod 18. There is a slot in each of the first and second oscillating rods 16, 18. The slots are staggered and arranged axially. The two slots form a "V" shape which corresponds to a "V" slot in the baseplate 1. A pin 13 covered by a sleeve 14 passes through the two "V" slots and connects to a link rod 12. The pin 13 pushes the first and second oscillating rods 16, 18, each of which rotates separately along the slot of the first and second oscillating rods 16,18, respectively.

A permanent magnetic actuator 2 is fixed to a first bracket 3. The first bracket 3 is fixed to the baseplate 1. One end of permanent magnetic actuator 2 connects with a link rod 5 via a pin 4. The link rod 5 connects to a third oscillating rod 8 via a pin 7. The third oscillating rod 8 and a fourth oscillating rod 10 are coupled to and rotate with a third rotating square shaft 9. One end of the third rotating square shaft 9 connects to the baseplate 1 through a bearing hole. The other end of the third rotating square shaft 9 connects to a second bracket 6 through a bearing hole. The second bracket 6 is fixed to the baseplate 1. The third oscillating rod 8 and the fourth oscillating rod 10 are staggered axially and vertically. The fourth oscillating rod 10 further connects with link rod 12 via a pin 11. The other end of permanent magnetic actuator 2 is fixed with link rod 23. Link rod 23 is welded to link rod 22, and link rod 22 connects with a slot in guide plate 20 via pin 21. This arrangement allows the guide plate 20 to be operatively rotated by the permanent magnetic actuator 2. Guide plate 20 connects to the baseplate 1 via pin 19.

Figure 2:
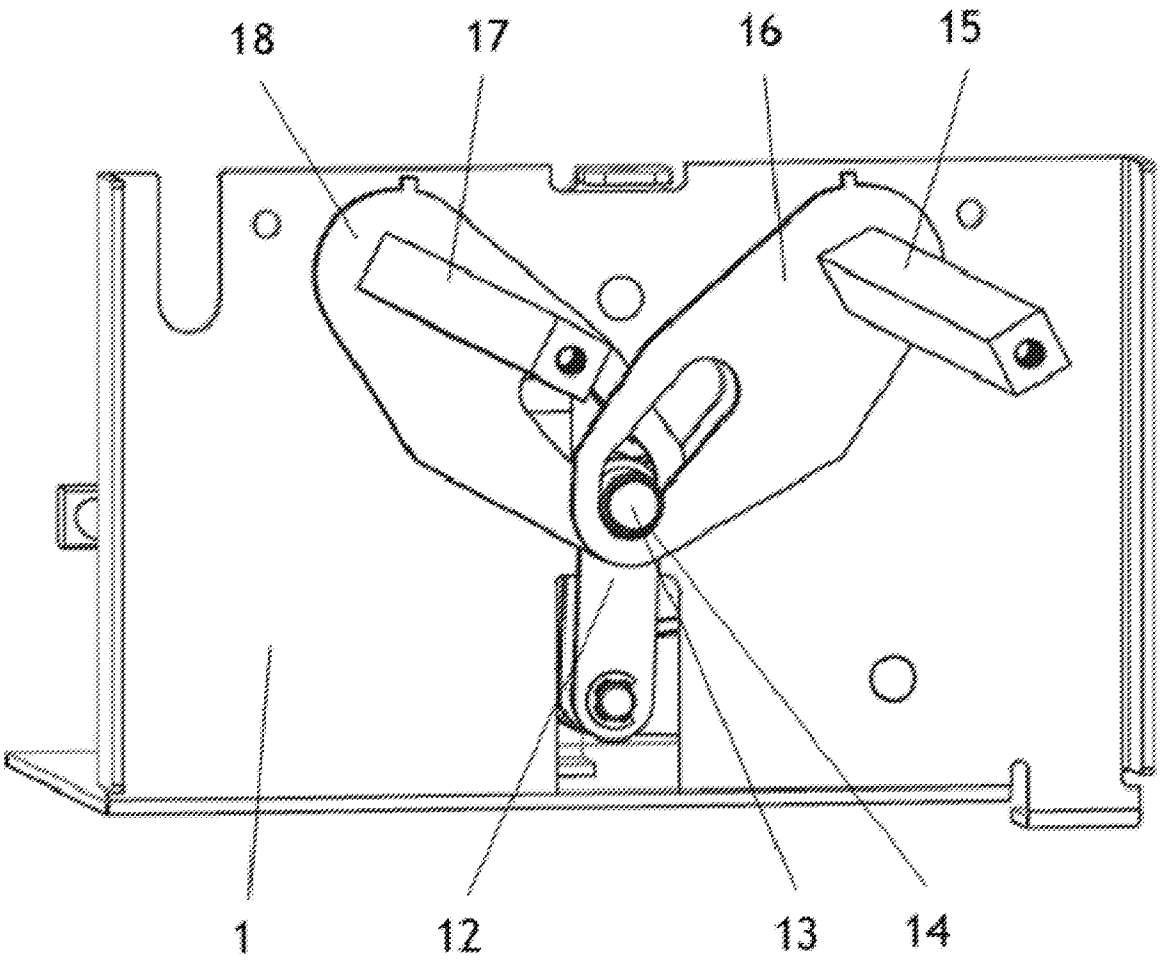
FIG. 2 is an isometric view of the automatic transfer switch of FIG. 1, with the contact and arc chute components removed.

Referring to FIG. 2, an isometric view of the automatic transfer switch of FIG. 1, with the contact and arc chute components removed, is illustrated. The pin 13 covered by the sleeve 14 passes through a "V" slot in baseplate 1 and the slots of the first and second oscillating rods 16,18 and connects to the link rod 12. The other end of the permanent magnetic actuator 2 via guide plate 20 (not shown) selects one of the two legs of the "V" in the baseplate 1 for the pin 13 to operate along. The pin 13 pushes the first and second oscillating rods 16,18, each of which rotate separately along the slots of the first and second oscillating rods 16, 18. Rotating square shafts 15 and 17 are fixed to the first and second oscillating rods 16, 18, respectively, and rotate with the respective oscillating rod.

As shown in FIGS. 3A, 3B, 4A, 4B, 5A and 5B, the ATS can be configured to one of a neutral state, a first non-neutral state, and a second non-neutral state. In the neutral state, both the source A movable contact subsystem 25 and the source B movable contact subsystem 27 are in an open position (i.e., not in contact with the fixed contact subsystem 26). The two-pole contact system includes at least two movable contact subsystems 24 which contain two sources of at least two-pole movable contact subsystem 25, 27, a fixed contact subsystem 26, a protective shell 28, and an arc chute system 29, which are assembled between source A and source B movable contact subsystems 25,27. The source A movable contact subsystem 25 is fixed to the rotating square shaft 15. The source A movable contact subsystem 25 rotates with the rotating square shaft 15 and couples the fixed contact subsystem 26 to the source A input. The source B movable contact subsystem 27 is fixed to the rotating square shaft 17. The source B movable contact subsystem 27 rotates with the rotating square shaft 17 and couples the fixed contact subsystem 26 to source B input.

Figure 3A:
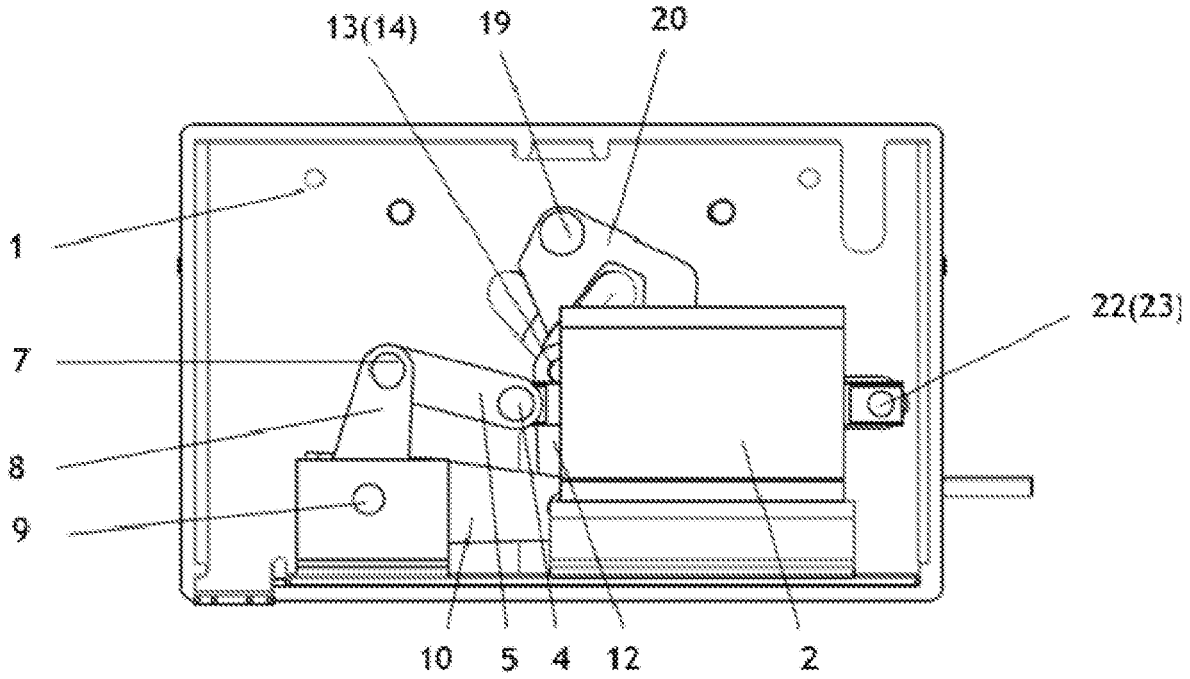
FIG. 3A is a sectional side view of the permanent magnetic actuator of the automatic transfer switch of FIG. 1, with the link rod in a neutral position.
Figure 3B:
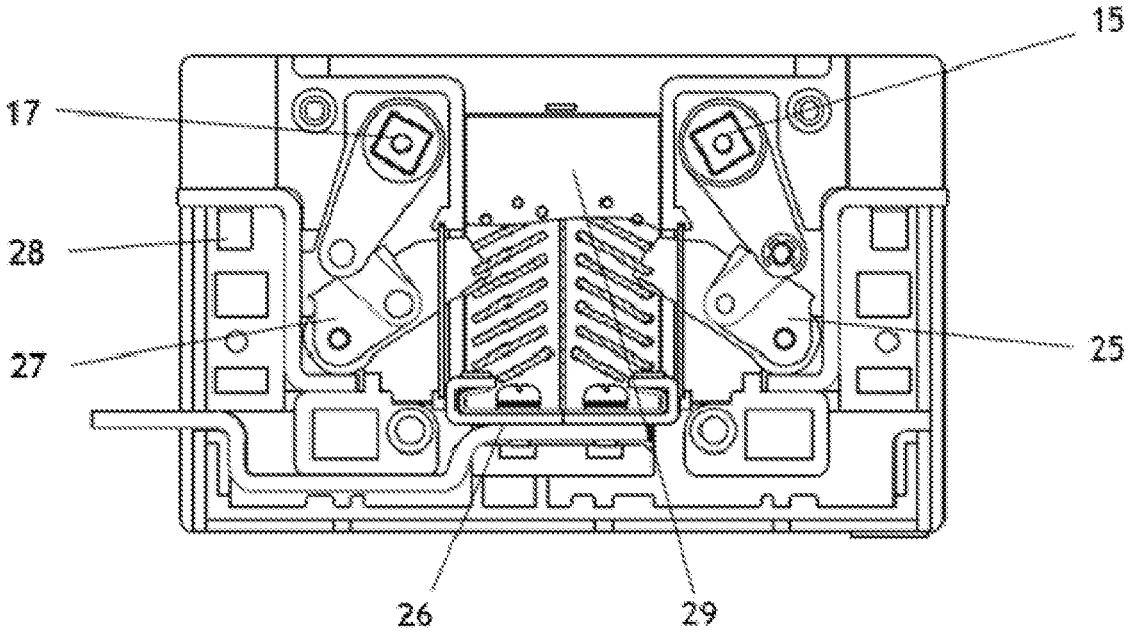
FIG. 3B is a sectional side view of a two-pole contact system of the automatic transfer switch of FIG. 1, with the first and second movable contact subsystems in a neutral position.

FIG. 3A is a sectional side view of the permanent magnetic actuator 2 of the automatic transfer switch of FIG. 1, with the link rod 12 and the pin 13 in a neutral state at the bottom of the "V" slot in the baseplate 1. FIG. 3B is a sectional side view of a two-pole contact system of the automatic transfer switch of FIG. 1, with the first and second movable contact subsystems 25,27 in a neutral state and the fixed contact subsystem 26 not coupled to either the source A movable contact subsystem 25 or the source B movable contact subsystem 27. The permanent magnetic actuator 2 utilizes a left permanent magnetic holding force to pull the link rod 5 to rotate the third oscillating rod 8 to a pre-determined angle in a clockwise direction along the third rotating square shaft 9. This causes the fourth oscillating rod 10 to rotate to a pre-determined angle in a clockwise direction along the third rotating square shaft 9, with the position of the fourth oscillating rod 10 then maintained at the pre-determined angle. The fourth oscillating rod 10 pulls the link rod 12 down with the pin 13 and the sleeve 14 moving along the "V" slot in the baseplate 1 to the bottom, keeping the movable contact subsystems 25, 27 in an open neutral position and held in place by either permanent magnetic force or by the activated state of the permanent magnetic actuator 2. The right end of permanent magnetic actuator 2 remains still. The first and second oscillating rods 16, 18 both stay in a position corresponding to the pre-determined angle that the rotating square shafts 15, 17 are rotated to, thereby placing the movable contact subsystems 25, 27 at a distance from the fixed contact subsystem 26. The distance can be, for example, a distance corresponding to a maximum angle from the fixed contact subsystem 26.

Figure 4A:
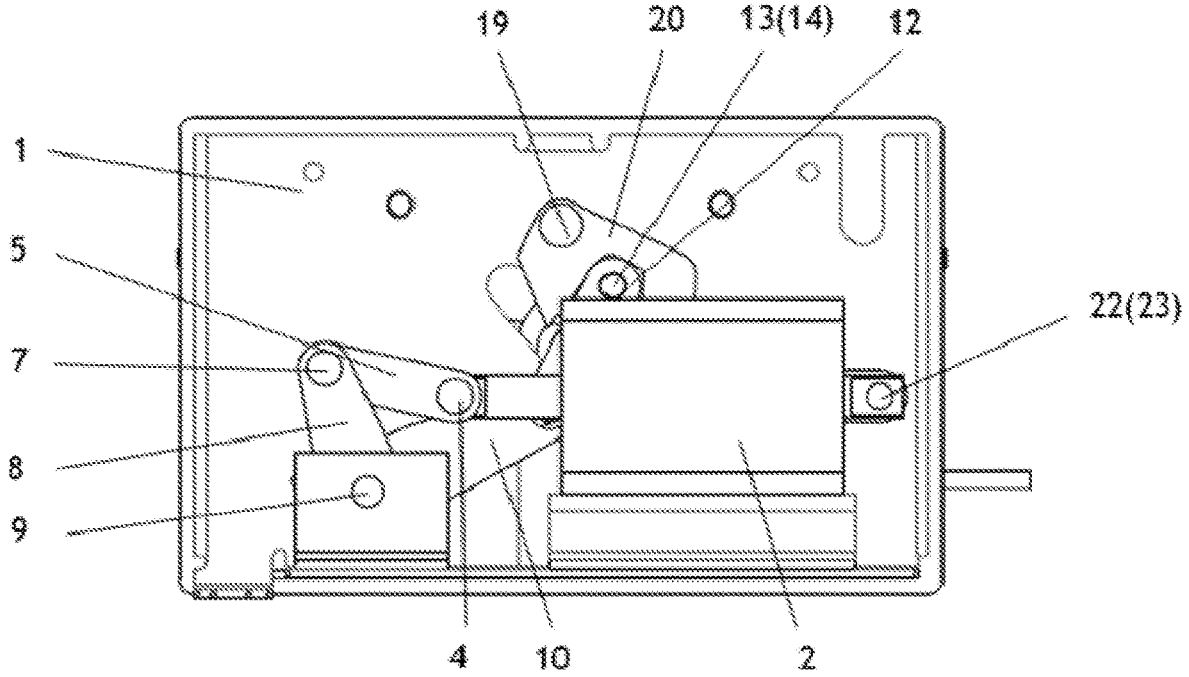
FIG. 4A is a sectional side view of the permanent magnetic actuator of the automatic transfer switch of FIG. 1, with the link rod in a first non-neutral state.
Figure 4B:
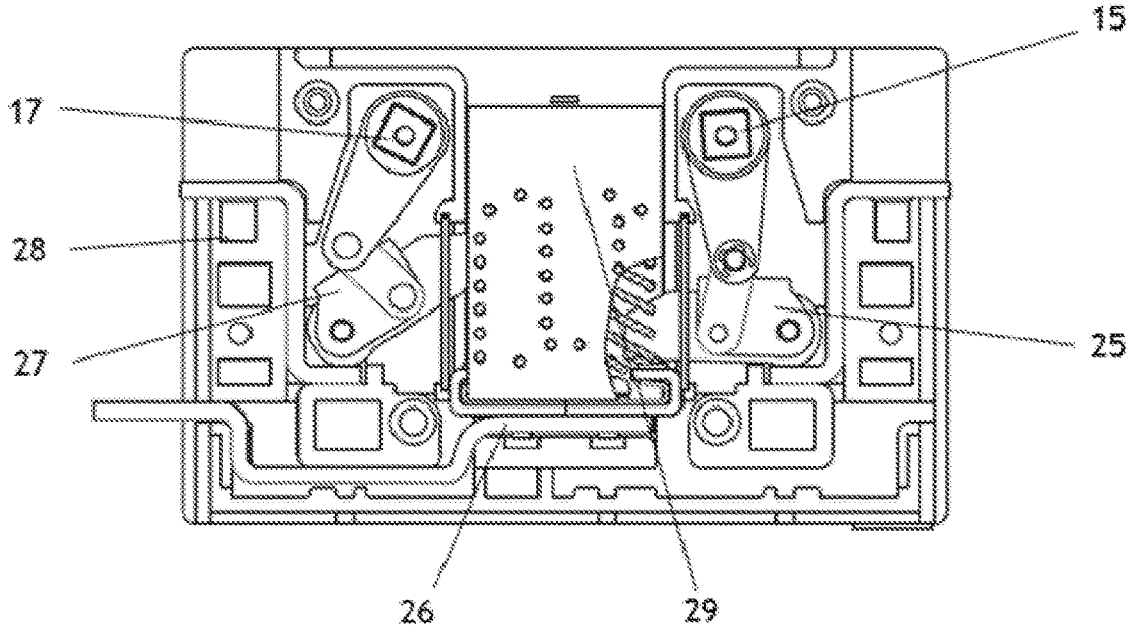
FIG. 4B is a sectional side view of a two-pole contact system of the automatic transfer switch of FIG. 1, with the first movable contact subsystem in a closed position.

FIG. 4A is a sectional side view of the permanent magnetic actuator of the automatic transfer switch of FIG. 1, with the link rod 12 in a first non-neutral state. Referring to FIG. 4B, a sectional side view of a two-pole contact system of the automatic transfer switch of FIG. 1 with the first movable contact subsystem in a closed position is illustrated. The left end of permanent magnetic actuator 2 utilizes a left permanent magnetic holding force to push the link rod 5, causing the third oscillating rod 8 to rotate to a pre-determined angle in a counterclockwise direction along the third rotating square shaft 9. This causes the fourth oscillating rod 10 to rotate to a pre-determined angle in a counterclockwise direction along the third rotating square shaft 9. The position of the fourth oscillating rod 10 is then maintained at the pre-determined angle. The fourth oscillating rod 10 pushes the link rod 12 upward with pin 13 and sleeve 14 moving along left side of the "V" slot in the baseplate 1 and the slot of second oscillating rod 18 to the top side and maintaining the position of the link rod 12. The right end of the permanent magnetic actuator 2 keeps still in this process, leaving the guide plate 20 in a first position to guide the movement of the pin 13 and the sleeve 14 along the left side of the "V" slot in the baseplate 1. The second oscillating rod 18 remains still and the first oscillating rod 16 is pushed upward by the pin 13 and the sleeve 14 with the first rotating square shaft 15 rotating a pre-determined angle so that the source A movable contact subsystems 25 comes into contact with the fixed contact subsystems 26, coupling the source A to the fixed contact subsystem 26, while the source B movable contact subsystems 27 remains open.

Figure 5A:
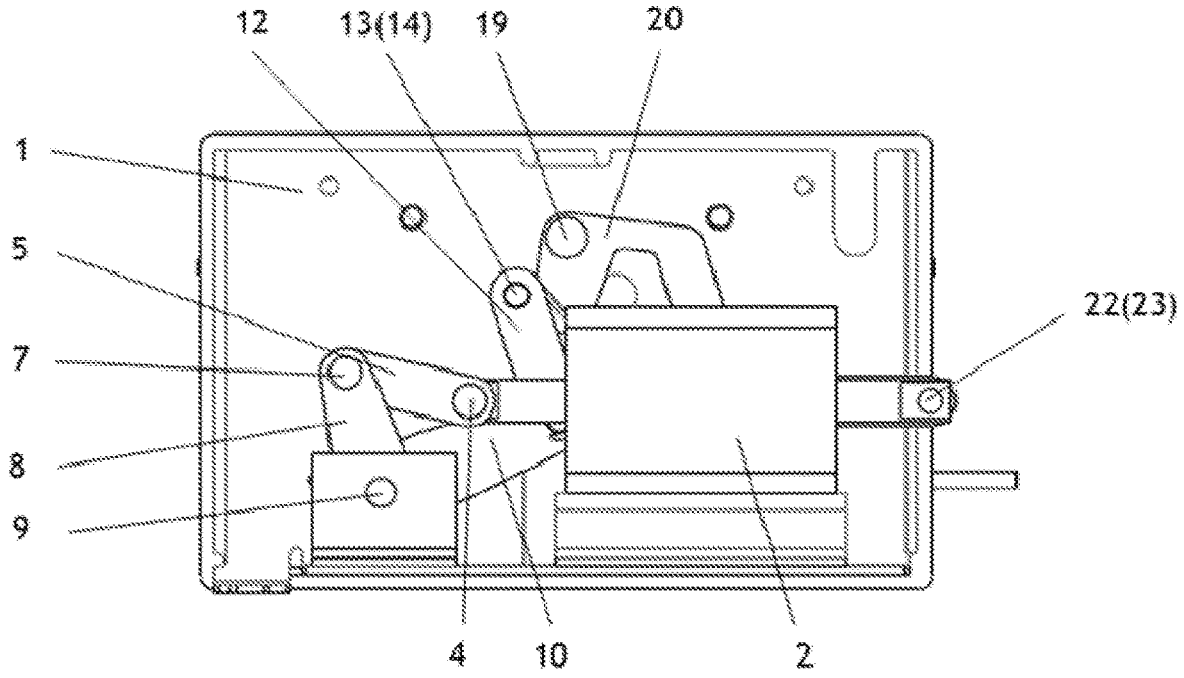
FIG. 5A is a sectional side view of the permanent magnetic actuator of the automatic transfer switch of FIG. 1, with the link rod in a second non-neutral state.
Figure 5B:
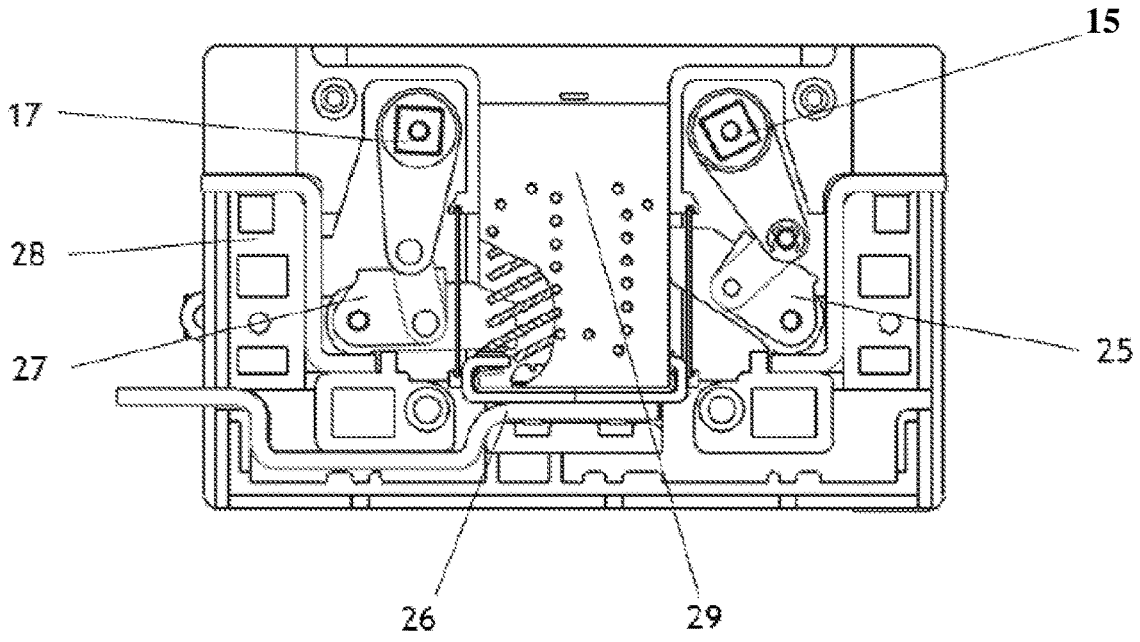
FIG. 5B is a sectional side view of a two-pole contact system of the automatic transfer switch of FIG. 1, with the second movable contact subsystem in a closed position.

Referring to FIG. 5A, a sectional side view of the permanent magnetic actuator 2 of the automatic transfer switch of FIG. 1, with the link rod 12 in a second non-neutral state, is illustrated. Referring to FIG. 5B, a sectional side view of a two-pole contact system of the automatic transfer switch of FIG. 1, with the second movable contact subsystem in a closed position, is illustrated. From the neutral state, with pin 13 positioned at the bottom of the "V" slot in baseplate 1, the right end of permanent magnetic actuator 2 is energized first and utilizes a permanent magnetic force to push the link rods 22, 23 forward to rotate guide plate 20 along pin 19 to a pre-determined position, causing the left side of the "V" slot in the baseplate 1 to be blocked and the right side of the "V" slot in the baseplate 1 to open. The left end of permanent magnetic actuator 2 utilizes a left permanent magnetic holding force to push the link rod 5 to rotate the third oscillating rod 8 to a pre-determined angle in counterclockwise direction along the third rotating square shaft 9, causing the fourth oscillating rod 10 to rotate to a pre-determined angle in a counterclockwise direction along the third rotating square shaft 9. The position of the fourth oscillating rod 10 is then maintained at the pre-determined angle. The fourth oscillating rod 10 pushes the link rod 12 upward with the pin 13 and the sleeve 14 moving along the right side of the "V" slot in baseplate 1 and the slot of the first oscillating rod 16 to the top side and maintaining the position of the link rod 12. The first oscillating rod 16 keeps still and the second oscillating rod 18 is pushed upward by pin 13 and sleeve 14 with the second rotating square shaft 17 rotating to a pre-determined angle so that source B movable contact subsystem 27 comes into contact with the fixed contact subsystem 26, coupling the source B to the fixed contact subsystem 26, and the source A movable contact subsystem 25 remains at a pre-determined angle such that the source A movable contact subsystem is positioned away from the fixed contact subsystem 26 in an open position.

In an embodiment, the ATS can transition from the configuration illustrated in FIGS. 4A and 4B to the configuration illustrated in FIGS. 5A and 5B, or vice versa. In an embodiment, the source A movable contact subsystem 25 can be in a contact position with the fixed contact subsystem 26 and the source B movable contact subsystem 27 can be in an open position. To switch the configuration, the source A movable contact subsystem 25 should first be opened to the neutral position. The source B movable contact subsystem 27 can then be closed from the neutral position, such that the source B movable contact subsystem 27 comes into contact with the fixed contact subsystem 26, and vice versa. In a further embodiment, the source A and B movable contact subsystems 25, 27 can be in a neutral position. In this case, before the source B movable contact subsystem 27 is closed, the right side of the permanent magnetic actuator 2 should be energized first and, utilizing a permanent magnetic force to pull the link rods 22,23 forward to rotate the guide plate 20 along pin 19 so that the left side of the "V" slot in the baseplate 1 is blocked and the right side of the "V" slot in the baseplate 1 is open. In yet another embodiment, the source A and B movable contact subsystem 25, 27 are again in a neutral position. In this case, before the source A movable contact subsystem 25 is closed, the right side of the permanent magnetic actuator 2 should be energized first, and a permanent magnetic force is utilized to push the link rods 22, 23 backward to rotate the guide plate 20 along pin 19 so that the right side of the "V" slot in the baseplate 1 is blocked and the left side of the "V" slot in the baseplate 1 is open.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "right," "left," etc.) are merely used to describe the orientation of various elements in the FIGURES. It should be noted that the orientation of various elements may differ according to other example embodiments, and that such variations are intended to be encompassed by the present disclosure.

It is important to note that the construction and arrangement of the various example embodiments are illustrative only. Although only a few embodiments have been described in detail in this disclosure, those skilled in the art who review this disclosure will readily appreciate that, unless specifically noted, many modifications are possible (e.g., variations in sizes, structures, shapes and proportions of the various elements, values of parameters, mounting arrangements, use of materials, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. Unless specifically noted, the order or sequence of any process or method steps may be varied or re-sequenced according to alternative embodiments. Other substitutions, modifications, changes and omissions may also be made in the design, operating conditions and arrangement of the various example embodiments without departing from the scope of the present invention.

What is claimed is:

1. An automatic transfer switch, comprising:

a fixed contact;

a first oscillating rod communicatively and operatively connected to a first movable contact;

a second oscillating rod communicatively and operatively connected to a second movable contact;

a link rod communicatively and operably connected to the first oscillating rod and the second oscillating rod;

a guide plate; and a permanent magnetic actuator including a first end and a second end, one of the first end or the second end being communicatively and operatively connected to the link rod via a third oscillating rod, the first end being energized independently of the second end, wherein the permanent magnetic actuator is configured to rotate one of the first oscillating rod and the second oscillating rod based at least on the position of a guide plate, and wherein a position of the guide plate is changed based at least on a permanent magnetic force applied to the one of the first end or the second end of the permanent magnetic actuator.

2. The automatic transfer switch of claim 1, wherein the automatic transfer switch is configured to be placed in any of a neutral state, a first non-neutral state, and a second non-neutral state.

3. The automatic transfer switch of claim 2, wherein the first movable contact and the second movable contact are positioned away from the fixed contact when the automatic transfer switch is in the neutral state.

4. The automatic transfer switch of claim 3, wherein the first movable contact and the second movable contact are positioned away from the fixed contact at a predetermined rotational angle when the automatic transfer switch is in the neutral state.

5. The automatic transfer switch of claim 2, wherein the first movable contact is in communication with the fixed contact and the second movable contact is positioned away from the fixed contact when the automatic transfer switch is in the first non-neutral state.

6. The automatic transfer switch of claim 2, wherein the first movable contact is positioned away from the fixed contact and the second movable contact is in communication with the fixed contact when the automatic transfer switch is in the second non-neutral state.

7. The automatic transfer switch of claim 2, wherein the permanent magnetic actuator is operable to change a state of the automatic transfer switch from the first non-neutral state to the second non-neutral state.

8. The automatic transfer switch of claim 7, wherein the permanent magnetic actuator is operable to change a state of the automatic transfer switch from the first non-neutral state to the second non-neutral state via the neutral state.

9. The automatic transfer switch of claim 8, wherein at least one of the first movable contact or the second movable contact is positioned away from the fixed contact.

10. The automatic transfer switch of claim 1, wherein the permanent magnetic actuator exerts a permanent magnetic holding force.

11. The automatic transfer switch of claim 10, wherein the permanent magnetic actuator is a bistable permanent magnetic actuator.

12. The automatic transfer switch of claim 10, wherein the permanent magnetic actuator is a monostable permanent magnetic actuator.

13. A method, comprising:

positioning, by a permanent magnetic actuator, a link rod to a neutral state from a first non-neutral state;

rotating a first oscillating rod based at least on positioning the link rod to the neutral state, the rotated first oscillating rod positioning a first movable contact at a distance from a fixed contact;

positioning a guide plate based at least on a permanent magnetic force applied to one of a first end or a second end of the permanent magnetic actuator, wherein the first end is energized independently of the second end;

positioning, by the permanent magnetic actuator, the link rod to a second non-neutral state from the neutral state based at least on the positioned guide plate; and rotating a second oscillating rod based at least on positioning the link rod to the second non-neutral state, wherein the rotated second oscillating rod is in communication with the fixed contact.

14. The method of claim 13, further comprising:

positioning, by the permanent magnetic actuator, the link rod to the neutral state from the second non-neutral state;

rotating the second oscillating rod based at least on positioning the link rod to the neutral state, the rotated second oscillating rod positioning the second movable contact at a distance from the fixed contact;

positioning the guide plate back based at least on a permanent magnetic force applied to the one of the first end or the second end of the permanent magnetic actuator, wherein the first end is energized independently of the second end; and positioning, by the permanent magnetic actuator, the link rod to the first non-neutral state from the neutral state based at least on the positioned guide plate.

15. The method of claim 13, further comprising:

positioning, by the permanent magnetic actuator, the link rod from the second non-neutral state to the first non-neutral state.

16. The method of claim 13, wherein at least one of the first movable contact or the second movable contact is positioned away from the fixed contact.

17. The method of claim 13, wherein the permanent magnetic actuator rotates the link rod based at least on a permanent magnetic holding force.

18. An automatic transfer switch, comprising:

a fixed contact;

first oscillating means communicatively and operatively connected to a first movable contact;

second oscillating means communicatively and operatively connected to a second movable contact;

linking means communicatively and operably connected to the first oscillating means and the second oscillating means;

guide means; and rotating means for rotating one of the first oscillating means or the second oscillating means based at least on the position of a guide means, the rotating means including a first end and a second end, one of the first end or the second end being communicatively and operatively connected to the linking means via a third oscillating means, the first end being energized independently of the second end, wherein a position of the guide means is changed based at least on a permanent magnetic force applied to the one of the first end or the second end of the rotating means.

* * * * *